US007310855B2

(12) United States Patent
Blocker et al.

(10) Patent No.: US 7,310,855 B2
(45) Date of Patent: Dec. 25, 2007

(54) VACUUM CLEANER COUNTER-BALANCE MECHANISM

(75) Inventors: Douglas L. Blocker, Festus, MO (US); John F. Kaido, St. Louis, MO (US); Keith R. Green, Bonneterre, MO (US)

(73) Assignee: Tacony Corporation, Fenton, MO (US)

( * ) Notice: Subject to any disclaimer, the term of this patent is extended or adjusted under 35 U.S.C. 154(b) by 533 days.

(21) Appl. No.: 10/888,160

(22) Filed: Jul. 9, 2004

(65) Prior Publication Data

US 2006/0005348 A1 Jan. 12, 2006

(51) Int. Cl.
*A47L 9/00* (2006.01)

(52) U.S. Cl. ..... 15/359; 15/339

(58) Field of Classification Search ..... 15/339, 15/359

See application file for complete search history.

(56) References Cited

U.S. PATENT DOCUMENTS

| | | | | |
|---|---|---|---|---|
| 1,937,765 | A | 12/1933 | Leathers | |
| 2,218,163 | A | 10/1940 | Carlson | |
| 2,226,362 | A | 12/1940 | White | |
| 2,243,066 | A | 5/1941 | Becker | |
| 2,291,250 | A | 7/1942 | Nielsen et al. | |
| 2,525,282 | A | 10/1950 | Brace | |
| 2,671,924 | A | 3/1954 | Segesman | |
| 2,684,271 | A | 7/1954 | Brace | |
| 3,154,802 | A | 11/1964 | Hanschitz et al. | |
| 3,188,681 | A | 6/1965 | Jepson et al. | |
| 5,353,471 | A | 10/1994 | Gühne et al. | |
| 6,286,181 | B1 | 9/2001 | Kasper et al. | |
| 6,772,474 | B2 * | 8/2004 | Nishikori et al. | 15/359 |

* cited by examiner

*Primary Examiner*—Theresa T. Snider
(74) *Attorney, Agent, or Firm*—Senniger Powers

(57) ABSTRACT

A vacuum cleaner is provided having a cleaning head and a main body pivotally mounted to the cleaning head which includes a counter-balance mechanism having at least one torsion spring with a first end thereof mounted for pivotal movement about a fixed axis in either the cleaning head or the main body and a second end thereof mounted for pivotal movement about a fixed axis in the other of the cleaning head or the main body, with the at least one torsion spring having a main body portion which is free to move as the main body of the vacuum cleaner is pivoted relative to the cleaning head, the counter-balancing force of the at least one torsion spring increasing as the main body of the vacuum cleaner is pivoted from a generally vertical position to a generally horizontal position while the cleaning head remains generally horizontal.

11 Claims, 7 Drawing Sheets

VACUUM CLEANER COUNTER-BALANCE MECHANISM

BACKGROUND OF THE INVENTION

The present invention relates to vacuum cleaners, particularly upright style vacuum cleaners and, more particularly, to a counter-balance mechanism for compensating for the weight of the handle and main body of the vacuum cleaner when it is tilted relative to the cleaning head of the vacuum cleaner.

It is well known in the prior art to provide a counter-balance mechanism for the handle and main body portion of an upright vacuum cleaner to reduce the weight supported by the operator when the handle and main body of the vacuum cleaner is moved from its upright position to a more horizontal position. Such counter-balance mechanisms generally use a torsion spring. The counter-balance mechanism is generally positioned between the main body and cleaning head of the vacuum cleaner so that as the handle is moved from an upright position to a more horizontal position the counter-balance mechanism increases the counter force supplied by the torsion spring so that more of the weight is carried by the cleaning head rather than the operator through the handle. Such counter-balance mechanisms hold the torsion coils in a fixed location so that the coiling and uncoiling occur around a fixed central axis utilizing a central shaft or an outer cylinder encasing the torsion coils, many in such a manner that the coils of the torsion spring engage the shaft or cylinder causing substantial wear over time and interfering with the effective rate of the spring so as to either lesson the counter force or increase it. Some of these prior art devices, such as U.S. Pat. Nos. 2,291,250 and 2,684, 271, teach the use of torsion springs in which one or both of the ends of the spring are free to move in a straight line over an engaging surface as the main body is pivoted relative to the cleaning head. This later design, in particular, promotes substantial wear as the spring end moves over the mating surface, eventually leading to breakage.

SUMMARY OF THE INVENTION

The present invention overcomes the above-described difficulties and disadvantages associated with prior art counter-balancing mechanisms. In one preferred embodiment of the present invention a vacuum cleaner is provided having a cleaning head and a main body pivotally mounted to the cleaning head which includes a counter-balance mechanism having at least one torsion spring with a first end thereof mounted for pivotal movement about a fixed axis in either the cleaning head or the main body and a second end thereof mounted for pivotal movement about a fixed axis in the other of the cleaning head or the main body, with the at least one torsion spring having a main body portion which is free to move as the main body of the vacuum cleaner is pivoted relative to the cleaning head, the counter-balancing force of the at least one torsion spring increasing as the main body of the vacuum cleaner is pivoted from a generally vertical position to a generally horizontal position while the cleaning head remains generally horizontal.

In another aspect of the preferred embodiment of the vacuum cleaner of the present invention, the main body is pivotally mounted to the cleaning head with a pivotal axis such that the fixed axis in the main body is movable from a position below the fixed axis in the cleaning head and below a horizontal plane passing through the pivotal axis to a position above the fixed axis in the cleaning head and above the horizontal plane passing through the pivotal axis when the main body of the vacuum cleaner is disposed in a generally horizontal position wherein the torsion spring exerts a force on the main body and the cleaning head forcing both the main body and the cleaning head toward horizontal.

In a further aspect of the preferred embodiment of the vacuum cleaner the fixed axis in the cleaning head and the fixed axis in the main body are movable relative to each other such that when the main body is moved from the generally vertical position to the generally horizontal position the spring exerts a force against the main body biasing the main body toward the vertical position and when the main body is in substantially the generally horizontal position the spring exerts a force against the cleaning head and the main body biasing them toward horizontal.

In yet a further aspect of the preferred embodiment, the vacuum cleaner also includes one of the first or second ends of the at least one torsion spring being looped and mounted for pivotal movement about an axle shaft fixedly mounted either in the cleaning head or the main body of the vacuum cleaner and the other of the first or second ends of the at least one torsion spring being captive for pivotal movement in a mount fixedly secured to the other of the cleaning head or main body of the vacuum cleaner. In yet a further aspect of the preferred embodiment of the vacuum cleaner the two torsion springs are joined at one end of each thereof and the joined ends of the torsion springs are captive in the mount.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various aspects all without departing from the invention. Accordingly, the drawings and descriptions will be regarded as illustrative in nature and not as restrictive.

DETAILED DESCRIPTION OF THE PREFERRED EMBODIMENT

Figure 1:
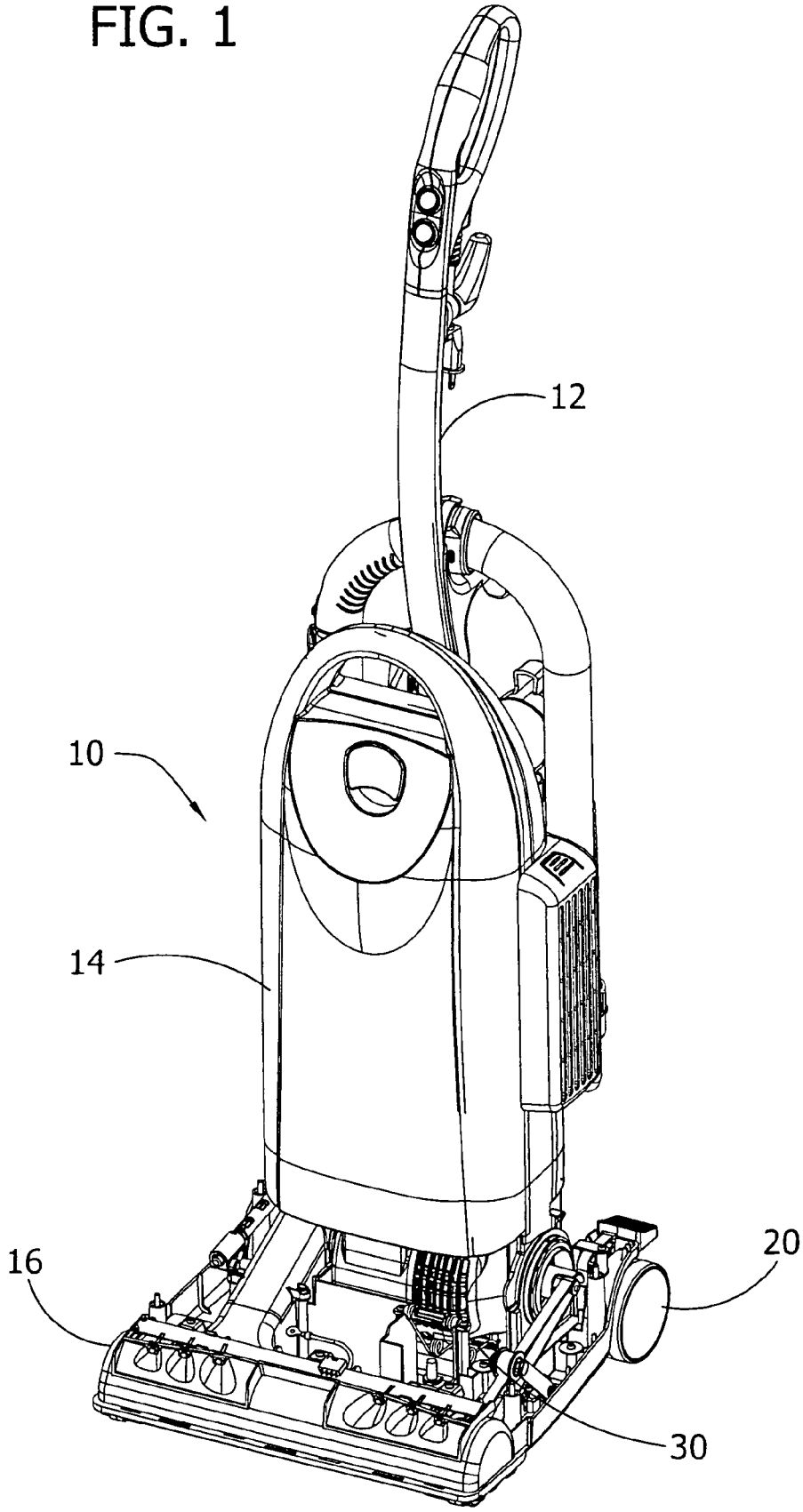
FIG. 1 is a front perspective view of a vacuum cleaner with some panels removed to illustrating the counter-balance mechanism of the preferred embodiment of the present invention.
Figure 2:
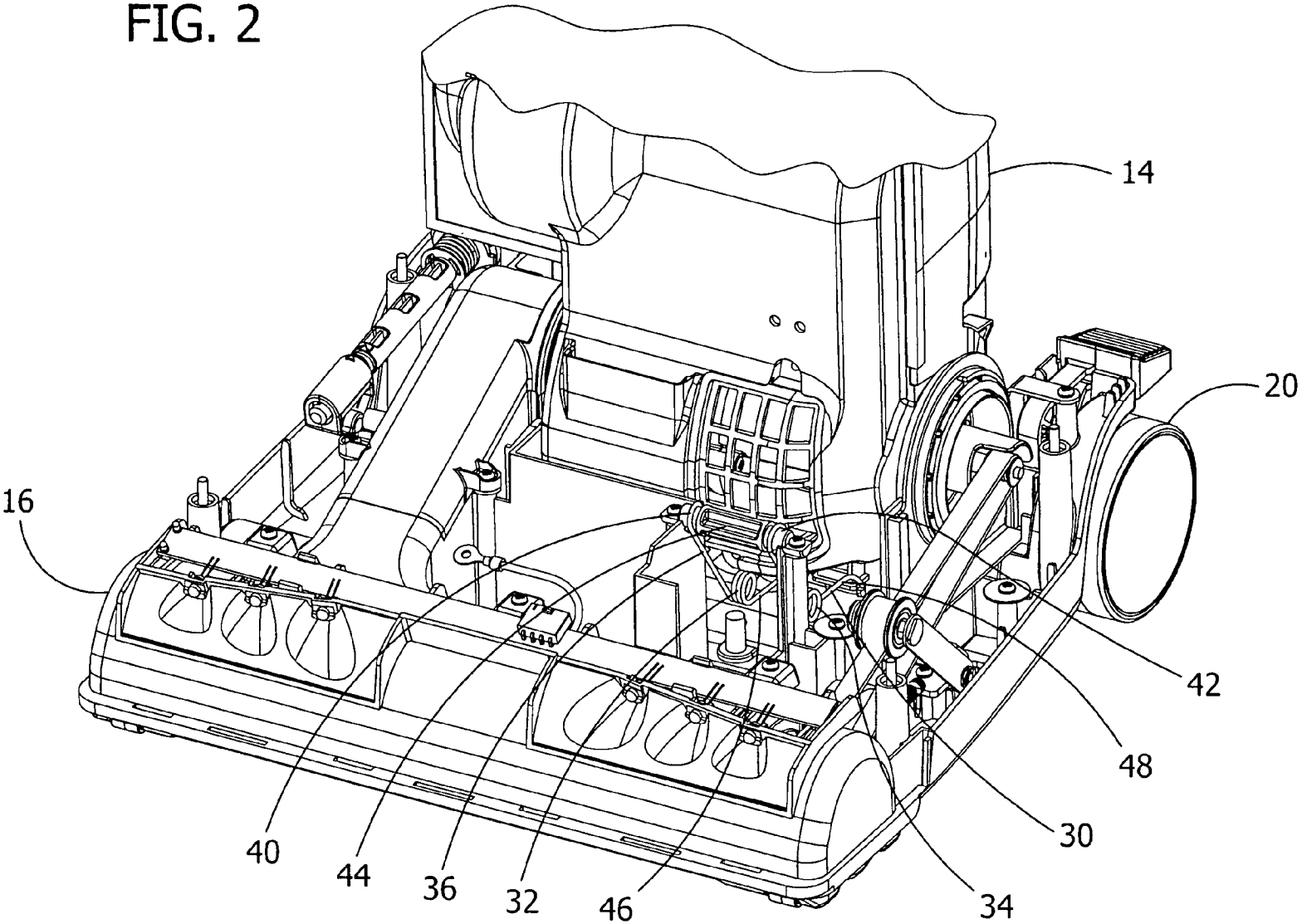
FIG. 2 is an enlarged partial front perspective view of the vacuum cleaner of FIG. 1 with some panels removed showing the counter-balance mechanism of the preferred embodiment of the present invention.
Figure 3:
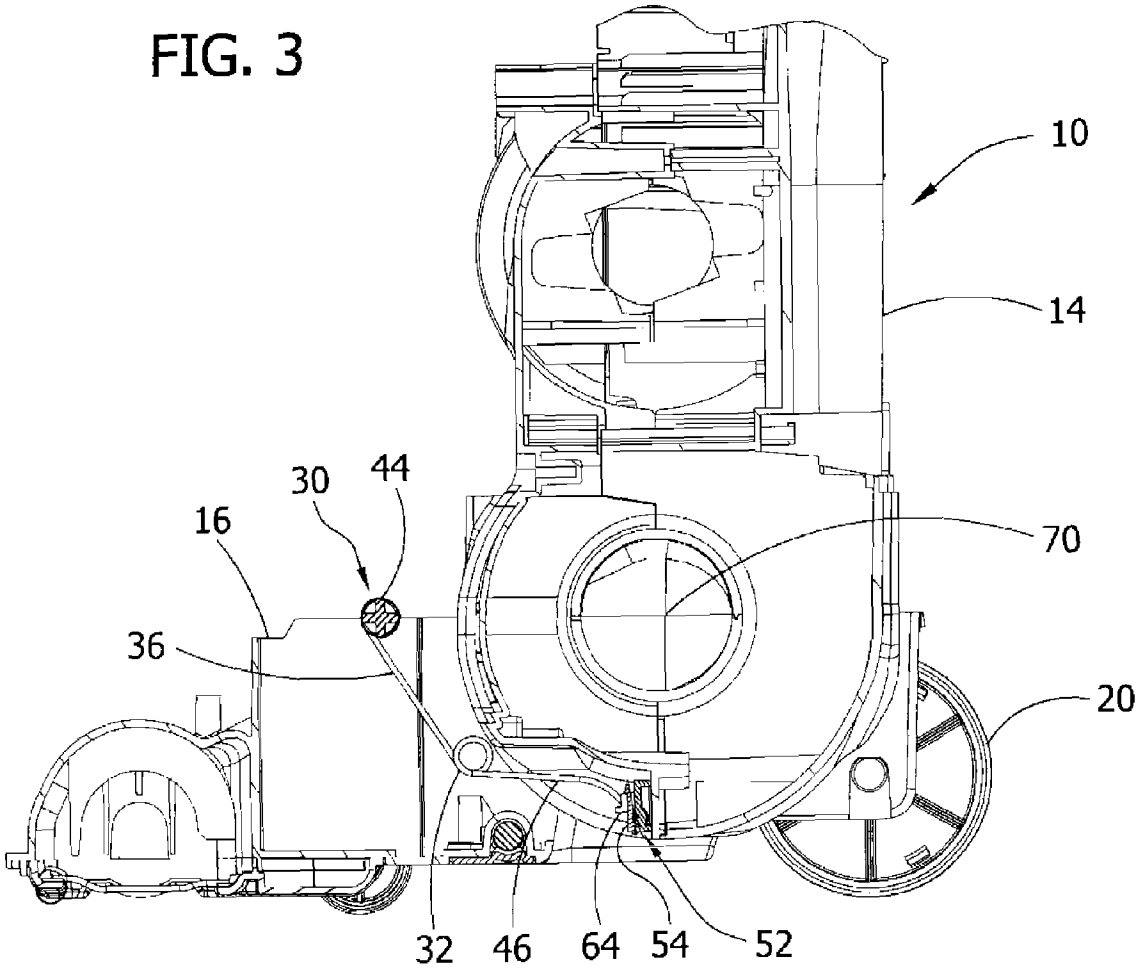
FIG. 3 is an enlarged partial cross-sectional side view of a of a portion of the vacuum cleaner of FIG. 1 showing the counter-balance mechanism with the main body of the vacuum cleaner in a vertical position.

Referring to FIGS. 1 and 3, an upright vacuum cleaner 10, constituting a preferred embodiment of the present invention, is shown having a handle 12 extending out of and connected to a main body 14. The main body 14 is pivotally connect to a cleaning head 16 so that the handle 12 can be pivoted in a vertical plane as is generally well known in the art in order to maneuver the cleaning head over a surface to be cleaned. The cleaning head 16 is supported by a pair of rear wheels 20 (only one being shown) and a pair of front wheels (not shown). The rear wheels 20 and front wheels are mounted for rotation to the cleaning head 16. Mounted for rotation in the front of the cleaning head 16 just in front of the wheels is a brush roller (not shown) for agitating the dust on a surface to be cleaned so that the dust can be picked up by a vacuum source (not shown) disposed directly behind the brush roller.

As best seen in FIGS. 2-5 and 8, a preferred embodiment of counter-balance mechanism, shown generally as 30, is provided which includes a pair of laterally spaced apart torsion springs 32 and 34, each with an equal number of multiple loops. A first end 36 of spring 32 and a first end 38 of spring 34 extend away from the loops and have their outer ends formed into respective loops 40 and 42 which are mounted for pivotal movement to opposite ends of an axle 44. Axle 44 is fixedly mounted, such as by screws, to the cleaning head 16. Second ends 46 and 48 of torsion springs 32 and 34, respectively, extend away from the loops of the springs 32 and 34 and are slightly arched and joined together at their outer ends to form a straight portion 50, parallel to axle 44, and which is received in a mount 52 for pivotal movement. Springs 32 and 34 and their ends 36, 38, 46, 48 and straight portion 50 are all preferably formed from a single piece of spring wire and comprise the counter-balance mechanism 30.

Figure 7:
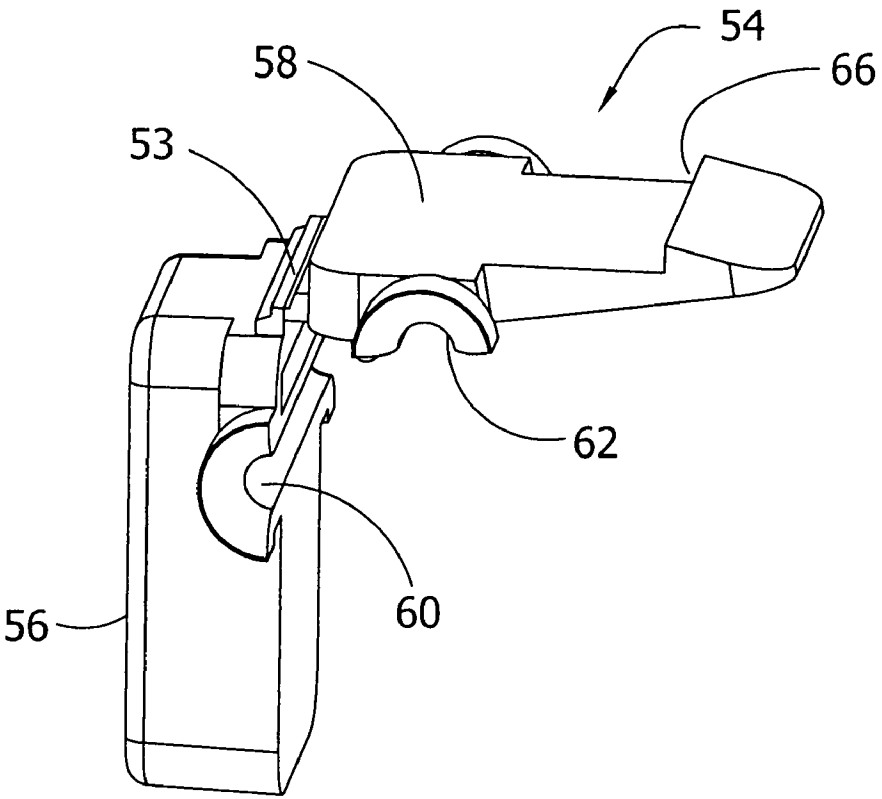
FIG. 7 is a pictorial view of the bracket of FIG. 6 in an open position.
Figure 6:
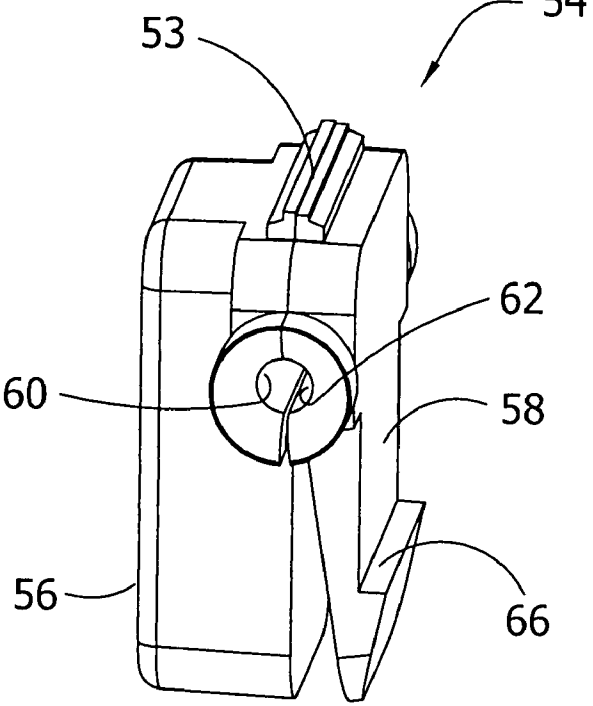
FIG. 6 is an enlarged pictorial view of a mounting bracket in a closed position for holding the counter-balance mechanism.
Figure 8:
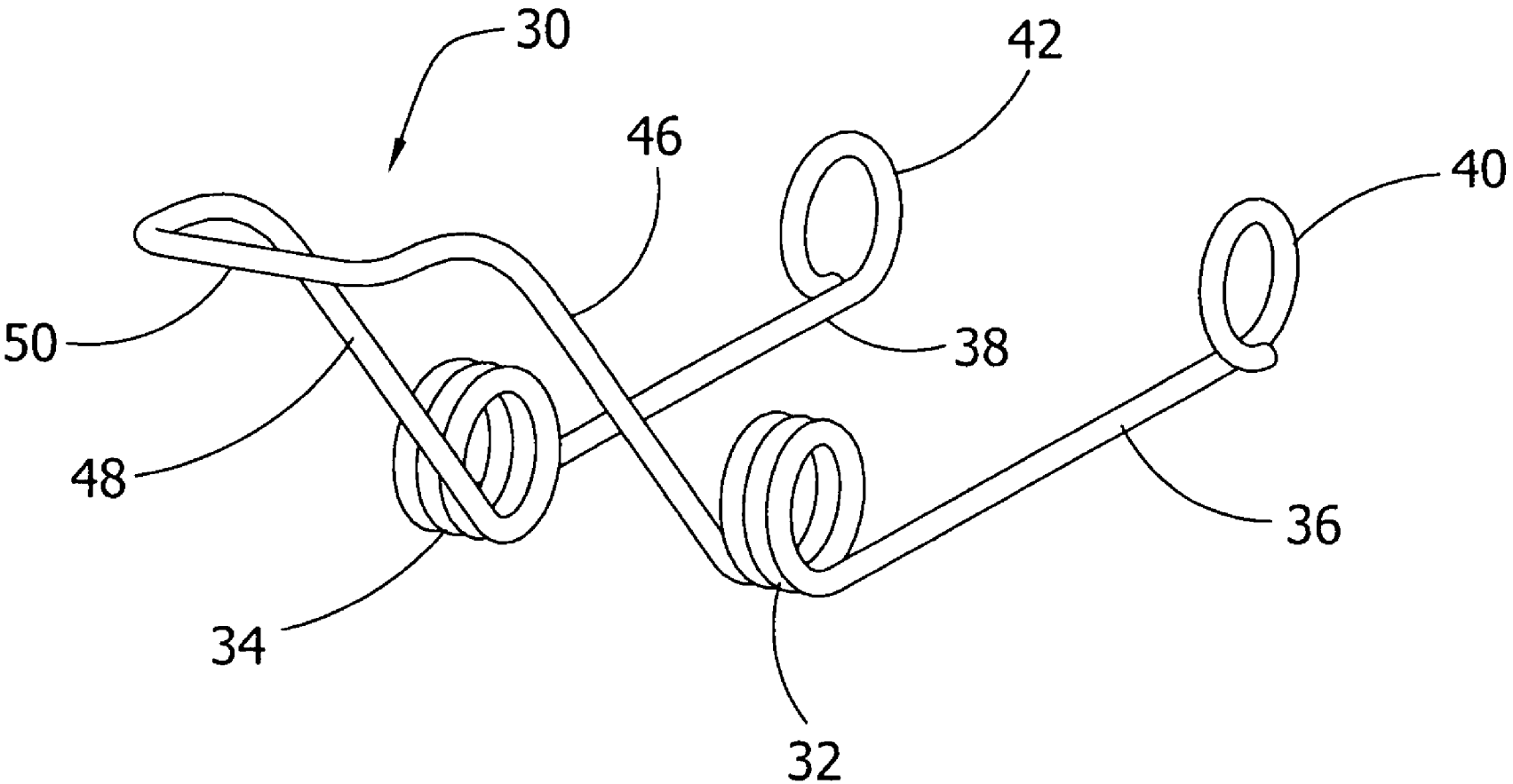
FIG. 8 is a pictorial view of the spring of the preferred embodiment of the present invention.

As shown in FIG. 3, a mount 52, which captures the straight portion 50 of counter-balance mechanism 30, is fixedly secured to the main body 14 of the vacuum cleaner 10. Mount 52 includes a bracket 54 (see FIGS. 6 and 7), preferably made of plastic, which is essentially two generally rectangular pieces 56 and 58 connected by a live hinge 53 extending between adjacent outer edges of pieces 56 and 58. Grooves 60 and 62 are formed in the surface of pieces 56 and 58 and are aligned when the pieces are folded so as to receive straight portion 50 therein. Bracket 54 is folded around straight portion 50 and inserted into a receiving opening formed in the bottom portion of main body 14 which also includes a shelf 64 (see FIG. 3). Piece 58 is provided with a lip 66 on its outer surface so that when mount 52 is slid into the receiving opening formed in main body 14 and bracket 54 expands slightly do to the natural spring action of live hinge 53, lip 66 will engage shelf 64 and prevent bracket 54 from coming out of the receiving opening to thus hold straight portion 50 in position. It is understood that the respective locations of the axle 44 and the mount 42 may be reversed, whereby the axle is fixedly mounted to the main body 14 of the vacuum cleaner 10 and the mount is fixedly secured to the cleaning head 16.

Figure 4:
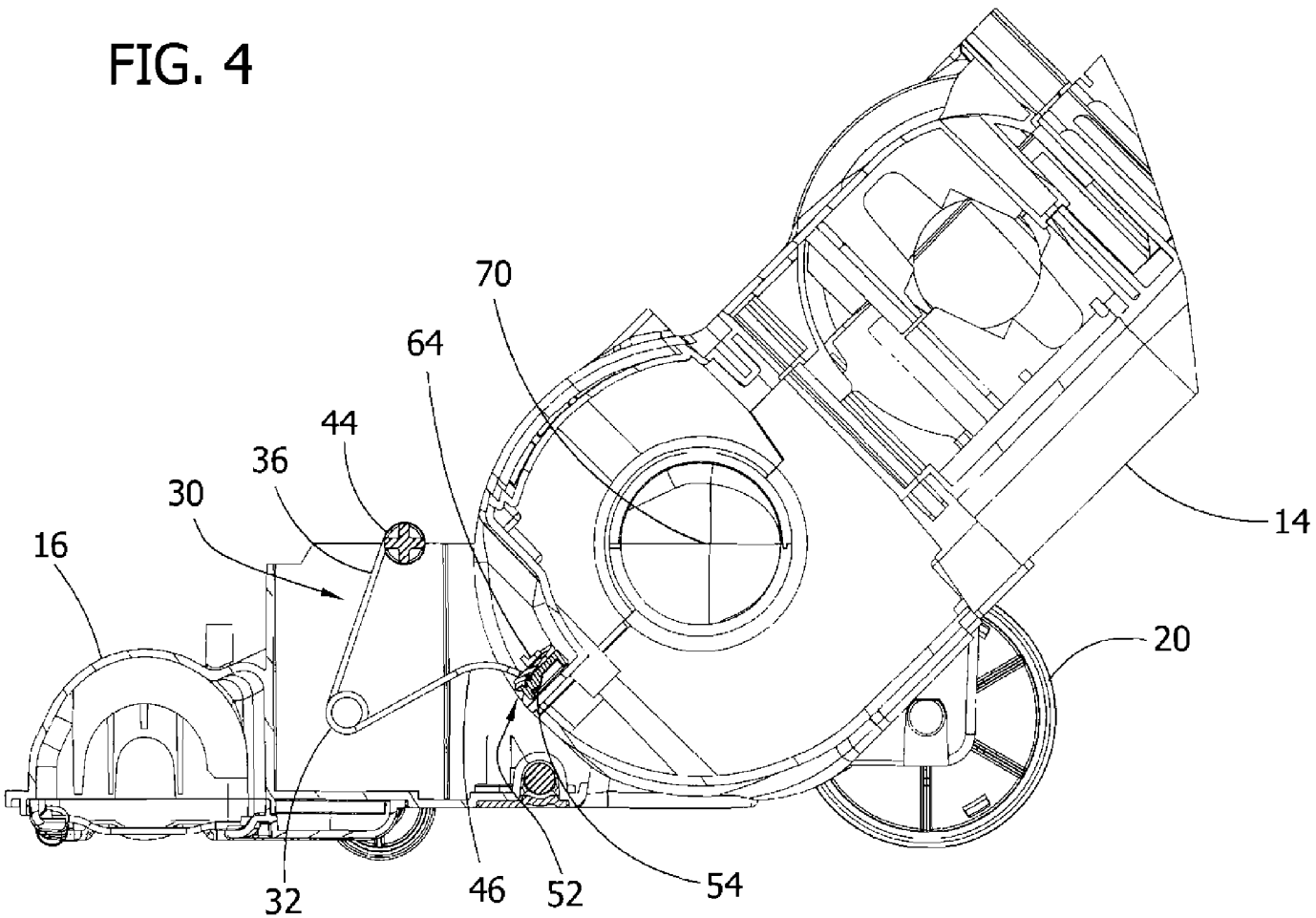
FIG. 4 is a view similar to FIG. 3 with the main body of the vacuum cleaner in an intermediate position.
Figure 5:
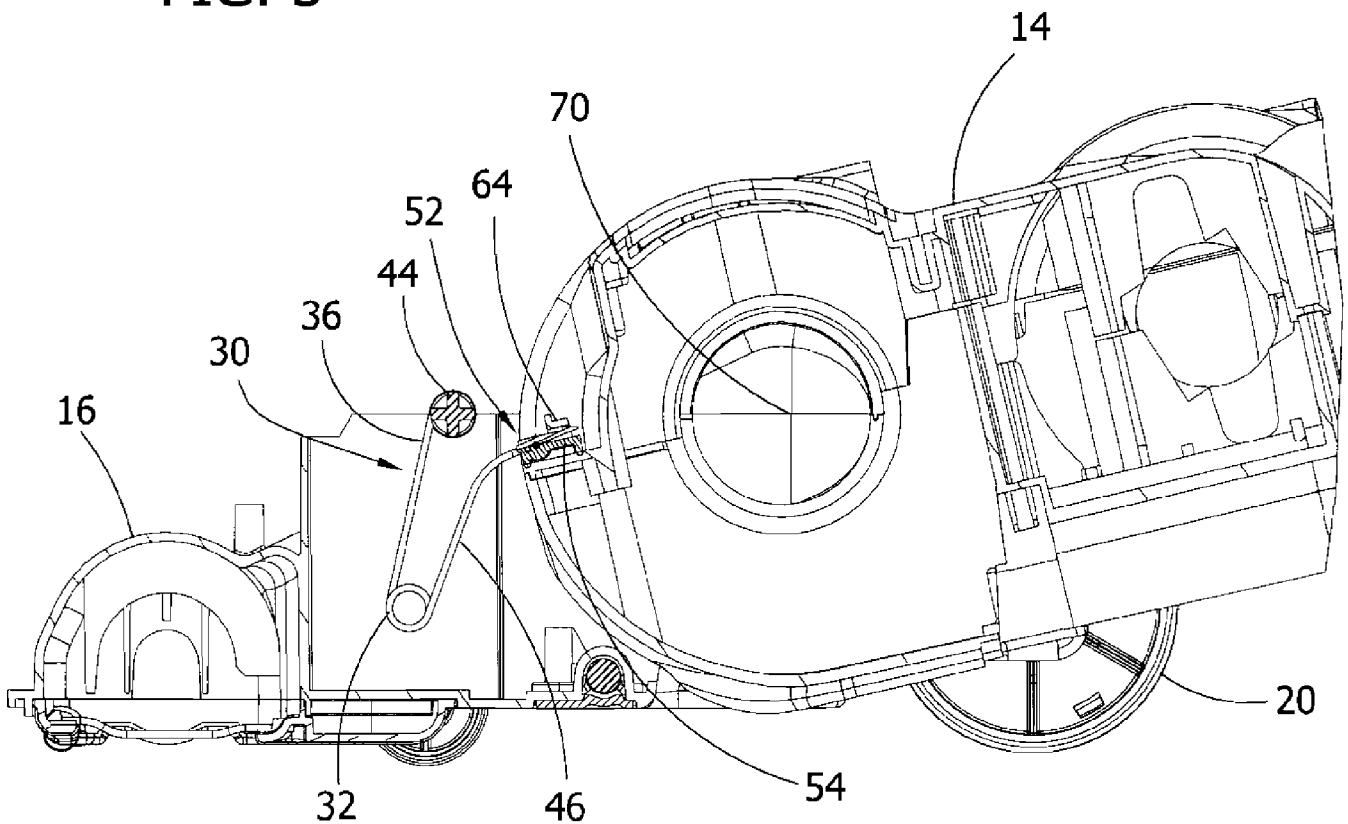
FIG. 5 is a view similar to FIG. 4 with the main body of the vacuum cleaner in a substantially horizontal position.

With regard to operation of the counter-balance mechanism 30, as shown in FIG. 3, the casing of the main body 14 of the vacuum cleaner 10 is removed and the inner shell (not shown) which supports the dust container bag (not shown) is in its upright vertical position relative to the cleaning head 16. The main body 14 is supported for pivotal movement about an axis 70 by structure not important to the present invention and will thus not be described in further detail. In the position shown in FIG. 3, the counter-balance mechanism 30 is in its extended, unloaded position. As the main body 14 of the vacuum cleaner 10 is pivoted downward by an operator to a position where the vacuum cleaner 10 is normally operated to be moved over and clean a surface, counter-balance mechanism 30 is partially compressed as shown in FIG. 4. As the movement of the handle 12 and main body continues to pivot towards a generally horizontal position, as shown in FIG. 5, the torsion springs 32 and 34 exert an ever greater force between the cleaning head 16 and main body 14 of vacuum cleaner 10 which tends to counter-balance the weight of the main body 14 and handle 12 that would otherwise be completely supported by the operator. Thus, the operator feels less weight which makes it easier for the operator to comfortably maneuver the vacuum cleaner 10.

However, as the main body moves beyond the position shown in FIG. 5 the straight portion 50 passes above a horizontal plane passing through the axis of rotation 70 of main body 14 putting the straight portion 50 in an over-center position with regard to the axis of rotation 70. In this position the counter balance mechanism 30 applies a force urging the main body 14 and handle 12 toward a horizontal position and thus toward the surface being cleaned. This also causes a similar force to be applied by loops 40 and 42 to axle 44 and thus to cleaning head 16 to urge it toward the horizontal and toward the surface being cleaned. By applying such forces to the cleaning head 16 and main body 14 the vacuum cleaner can be more easily used to sweep under sofas, beds and the like since the cleaning head will be biased in the direction of the floor rather than upward which could possibly cause the cleaning head 16 to lift off of the floor and reduce its cleaning effect.

When the handle 12 and main body 14 of vacuum cleaner 10 is pivoted about axis 70 from the position shown in FIG. 3 to that shown in FIG. 5, the loops 40 and 42 pivot about axle 44. At the same time, straight portion 50, which is formed by the joined ends of springs 32 and 34, pivots in mount 52. As this occurs, the loops 47 and 49, which form the main bodies of torsion springs 32 and 34, move freely within the cleaning head 16. Thus, there is nothing engaging the springs 32 and 34 which can affect the spring constant as occurs in many prior art counter-balance mechanisms, as discussed above. Since the actual spring constants and forces applied by the counter-balance mechanism 30 will vary for any given weight of the handle and main body for a specific vacuum cleaner and which can be easily determined, it is believed that no specific examples of such spring constants and forces need be given here.

When introducing elements of the present invention or the embodiment(s) thereof, the articles "a," "an," "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A vacuum cleaner having a cleaning head and a main body pivotally mounted to the cleaning head, comprising:

a counter-balance mechanism having at least one torsion spring with a first end thereof mounted for pivotal movement about a first fixed axis in either the cleaning head or the main body and a second end thereof mounted for pivotal movement about a second fixed axis in the other of the cleaning head or the main body, the at least one torsion spring having a main body portion which is free to move as the main body of the vacuum cleaner is pivoted relative to the cleaning head, the counter-balancing force of the at least one torsion spring increasing as the main body of the vacuum cleaner is pivoted from a generally vertical position to a generally horizontal position while the cleaning head remains generally horizontal.

2. The vacuum cleaner of claim 1 wherein the main body is pivotally mounted to the cleaning head with a pivotal axis such that the fixed axis in the main body is movable from a position below a horizontal plane passing through the pivotal axis to a position above the horizontal plane passing through the pivotal axis when the main body of the vacuum cleaner is disposed in a generally horizontal position wherein the torsion spring exerts a force on the main body and the cleaning head forcing both the main body and the cleaning head toward horizontal.

3. The vacuum cleaner of claim 1 wherein the fixed axis in the cleaning head and the fixed axis in the main body are movable relative to each other such that when the main body is moved from the generally vertical position to the generally horizontal position the spring exerts a force against the main body biasing the main body toward the vertical position and when the main body is in substantially the generally horizontal position the spring exerts a force against the cleaning head and the main body biasing them toward horizontal.

4. The vacuum cleaner of claim 1 further comprising an axle shaft fixedly mounted either in the cleaning head or the main body of the vacuum cleaner and defining the first axis, and a mount fixedly secured to the other of the cleaning head or main body of the vacuum cleaner and defining the second axis, wherein the first end of the at least one torsion spring is looped around the axle shaft, and wherein the second end of the at least one torsion spring is captive in the mount.

5. The vacuum cleaner of claim 4 wherein the at least one torsion spring includes two torsion springs joined together at one of the first and second ends.

6. The vacuum cleaner of claim 5 wherein the joined ends of the torsion springs are captive in the mount.

7. The vacuum cleaner of claim 4 wherein the axle shaft is fixedly mounted in the cleaning head of the vacuum cleaner and the mount is fixedly secured to the main body of the vacuum cleaner.

8. A vacuum cleaner having a cleaning head and a main body pivotally mounted to the cleaning head, comprising:

a counter-balance mechanism having two torsion springs with a first end of each thereof mounted for pivotal movement about a fixed axis in either the cleaning head or the main body and a second end of each thereof mounted for pivotal movement about a fixed axis in the other of the cleaning head or the main body, the two torsion springs having main body portions which are free to move as the main body of the vacuum cleaner is pivoted relative to the cleaning head, the counter-balancing force of the two torsion springs increasing as the main body of the vacuum cleaner is pivoted from a generally vertical position to a generally horizontal position while the cleaning head remains generally horizontal.

9. The vacuum cleaner of claim 8 further comprising an axle shaft fixedly mounted in the cleaning head and defining the first axis, and a mount fixedly secured to the main body of the vacuum cleaner and defining the second axis, wherein the first ends of the two torsion springs are looped around the axle shaft, and wherein the second ends of the two torsion springs are captive in the mount.

10. The vacuum cleaner of claim 9 wherein the second ends of the two torsion springs are joined.

11. The vacuum cleaner of claim 10 wherein the joined ends of the torsion springs are captive in the mount.

* * * * *